United States Patent [19]

Hicks, Jr.

[11] 4,068,768

[45] Jan. 17, 1978

[54] VIBRATOR BRACKET ASSEMBLY FOR HOPPERS AND RAILWAY CARS

[75] Inventor: Paul E. Hicks, Jr., Florissant, Mo.

[73] Assignee: ACF Industries, Incorporated, New York, N.Y.

[21] Appl. No.: 691,169

[22] Filed: May 28, 1976

Related U.S. Application Data

[62] Division of Ser. No. 554,931, March 3, 1975, Pat. No. 4,039,128.

[51] Int. Cl.[2] ..... B65G 67/24

[52] U.S. Cl. ..... 214/64.2; 214/83.3; 248/14

[58] Field of Search ..... 214/64.2, 83.3; 105/247; 222/161

[56] References Cited

U.S. PATENT DOCUMENTS

| | | | |
|---|---|---|---|
| 2,074,768 | 3/1937 | Beaver | 105/247 |
| 2,229,037 | 1/1941 | Boldman | 214/83.3 |
| 2,504,789 | 4/1950 | Bankauf et al. | 214/64.2 |
| 3,420,480 | 1/1969 | Matson | 214/64.2 |
| 3,468,504 | 9/1969 | Matson | 214/64.2 |
| 3,515,051 | 6/1970 | Pulcrano | 105/247 |

*Primary Examiner*—Lawrence J. Oresky
*Assistant Examiner*—Lawrence E. Williams
*Attorney, Agent, or Firm*—Henry W. Cummings

[57] ABSTRACT

A railway hopper car is provided with a mounting bracket assembly which applies the vibrational loads to the car essentially entirely in shear.

13 Claims, 7 Drawing Figures

VIBRATOR BRACKET ASSEMBLY FOR HOPPERS AND RAILWAY CARS

This is a division, of application Ser. No. 554,931, filed Mar. 3, 1975, now U.S. Pat. No. 4,039,128, Aug. 8, 1977.

BACKGROUND OF THE INVENTION AND OBJECTS

It is known in the art to apply a vibrator to a railway car to assist in unloading difficult to unload loadings. The vibrator tends to break up and dislodge bridged or clogged lading. Examples of such vibrator mountings on railway cars are shown in the following U.S. Pat. Nos. 1,634,008; 1,644,175; 2,108,416; 2,229,037; 2,621,813; 2,694,498; 2,706,566; 2,504,789; 3,420,480 and 3,468,504. However, these and other vibrator constructions apply the vibrational force to the railway car in such a way as to induce local bending and tension in the structural components to which the vibrator is attached. Particularly when high vibratory loads are utilized there is a tendency for part of the railway car to fail, particularly in fatigue, particularly at locations adjacent to the vibrator.

It therefore is an object of the present invention to provide a vibrator bracket assembly whereby the likelihood of fatigue failure of railway car parts is reduced.

It is another object of the present invention to provide a railway car vibrator bracket assembly which applies the vibrational loads to the car body in shear.

Other objects will be apparent from the following lescription and drawings.

SUMMARY OF THE INVENTION

In accordance with the present invention, a railway hopper car is provided with a vibrator bracket assembly for mounting vibrator equipment to apply the vibratory loads to the car essentially entirely in shear. The assembly includes at least two spaced apart support members each having a longitudinal axis adapted to integrally engage a structural portion of the hopper. A vibrator mounting bracket, having first and second planar surfaces parallel to the longitudinal axis of the support members, extends between the support members and is adapted to receive a vibrator to facilitate loading or unloading of the hopper. The vibrational forces are applied to the vibrator mounting bracket and are transmitted to the support members and are applied to the hopper structural portion by the support members essentially entirely as shear loads in the plane of the hopper structural portion. A mounting plate may be provided at right angles to the vibrator mounting bracket. The mounting plate is adapted to apply rotating vibrator loads to adjacent hopper structure essentially entirely in shear in the plane of the structure. Slotted plates may be used to mount a vibrator on a transverse bulkhead in the hopper.

In one embodiment a vibrator mounting bracket is applied longitudinally and horizontally to a hopper and the support members extend transversely into the hopper a short distance along adjacent hopper slope sheets to apply the vibratory loads in shear to the slope sheets. In another embodiment the vibrator braket assembly is mounted on the top of the hopper. The mounting bracket extends vertically above the hopper and the vibratory loads are applied to an interior transverse bulkhead in shear by means of spaced support members mounted perpendicular to opposite ends of the vibrator mounting bracket. In another embodiment the support members apply the shear loads to a single hopper slope sheet. In another embodiment the vibrator bracket assembly is applied horizontally to a straight sided hopper by means of support members extending longitudinally along one or more of the side sheets, or vertically by means of vertically extending support members extending along the side sheets. In another embodiment the loads are applied in shear to side sheets and end sheets and/or roof sheets or inclined slope sheets of a flat sided car.

THE DRAWINGS

DETAILED DESCRIPTION

Figure 2:
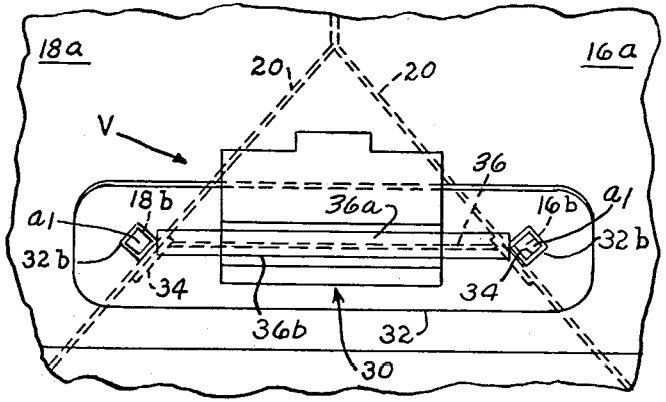
FIG. 2 is an enlarged view along the lines 2—2 in FIG. 1.
Figure 1:
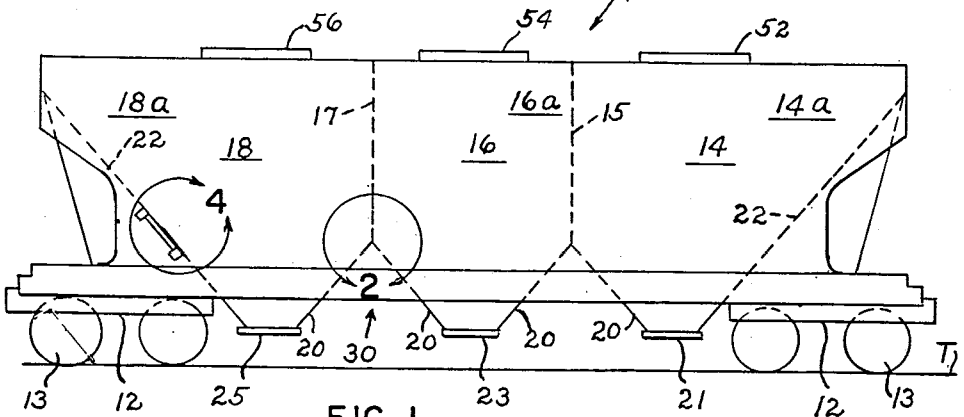
FIG. 1 is a side elevational view of a railway hopper car having curved sides to which the vibrator bracket assembly of the present invention is adapted to be utilized.
Figure 3:
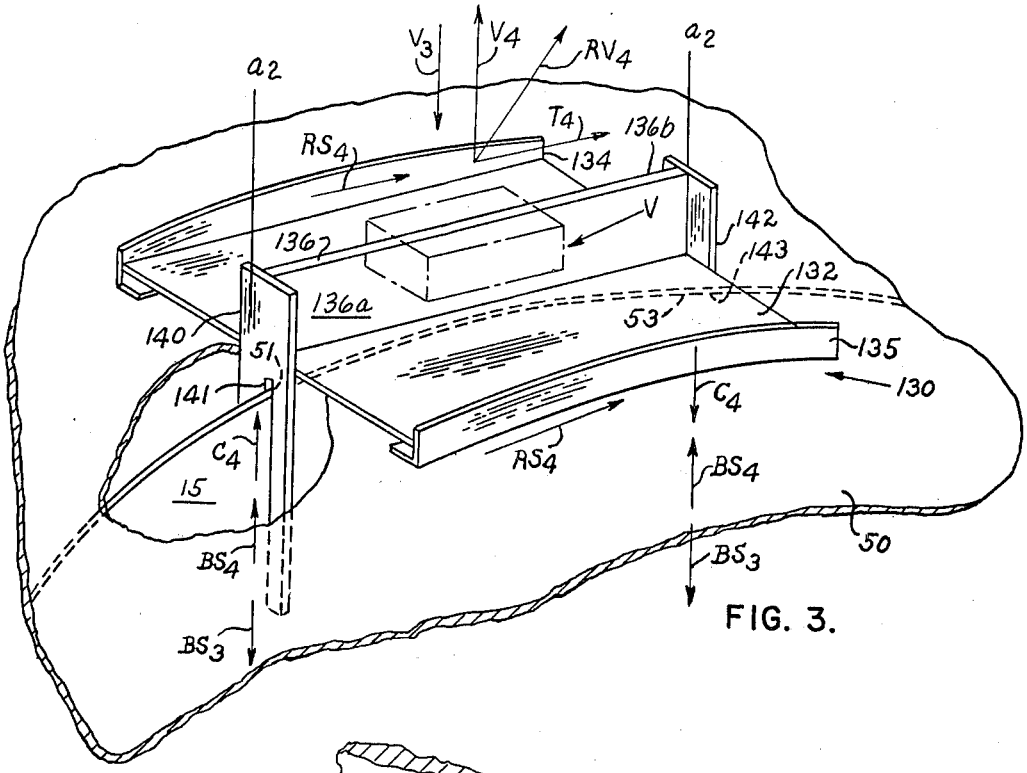
FIG. 3 is a perspective view of another embodiment of the present invention wherein the vibrator bracket assembly is mounted on the roof of the car.

In accordance with one embodiment of the present invention shown in FIGS. 1-3, a railway hopper car is indicated generally at 10. The hopper car comprises trucks 12 on opposite ends thereof having wheels 13 which support the hopper car on a railway car track T. Hopper car 10 comprises a plurality of hoppers 14, 16 and 18 having curved side sheets **14*a*, 16*a*, 18*a*, and having transverse bulkheads 15 and 17 respectively, therebetween. The car may comprise more or less hoppers as desired. End hoppers 14 and 18 have slope sheets 20 extending from the transverse bulkheads downwardly toward outlets 21, 23 and 25 respectively, and long slope sheets 22 extending over trucks 12. Hopper 16 has slope sheets 20, each extending downwardly from bulkheads 15 and 17 toward outlet 23**.

The vibratory bracket assembly of the present invention is indicated generally at 30 in the drawings and is preferably applied to the hopper car 10 below either or, if desired, below both transverse bulkheads 15 and 17. For the purpose of illustration, the enlarged view shown in FIG. 2 is taken below bulkhead 17.

Openings are drilled in the side sheets indicated at **16*b* and 18*b* respectively. Additionally, a metal plate 32 which has openings provided therein 32*b* is welded to side sheets 16*a* and 18*a*, as illustrated. Rods 34 are then placed in the respective openings 32*b*, 16*b* and 18*b* and are welded respectively to the slope sheets 20 in each of hoppers 16 and 18. Rods 34** have a longitudinal axis $a_1$ as shown in FIG. 2A.

Figure 2A:
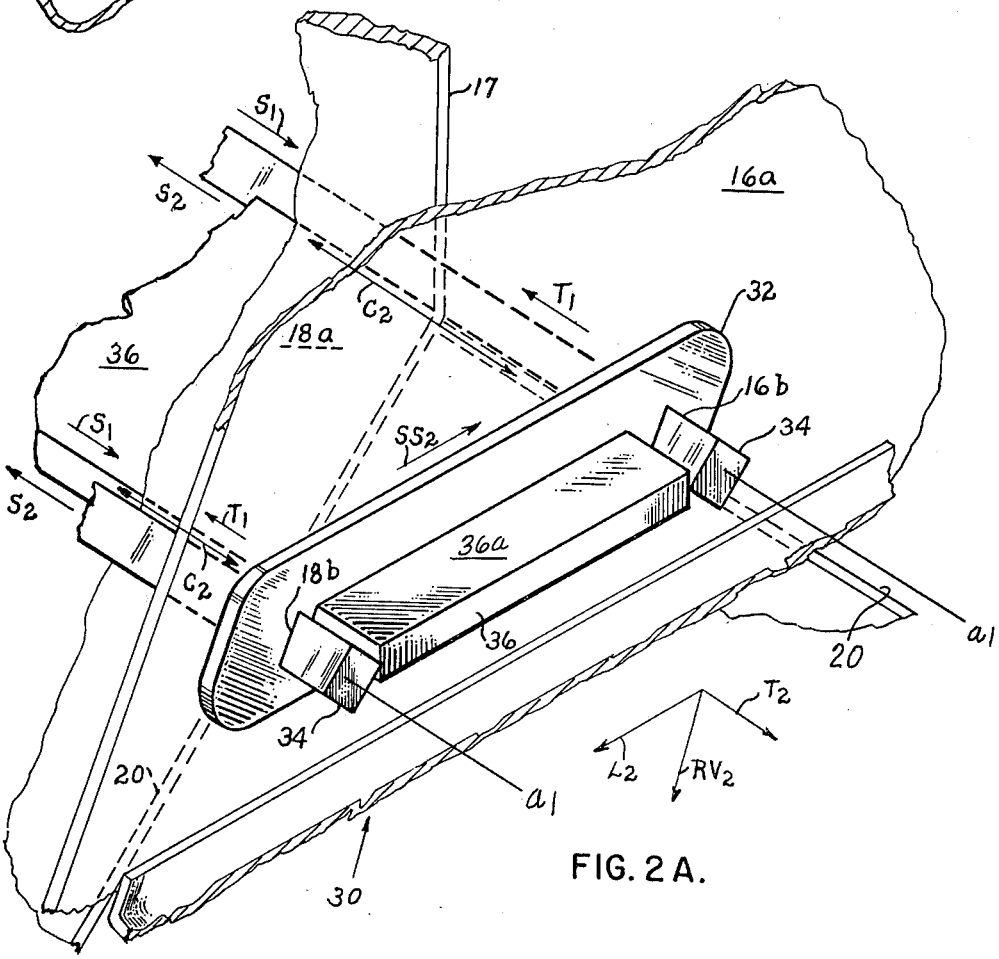
FIG. 2A is a perspective view along the lines 2—2 in FIG. 1 which shows the force vectors involved in the present invention.

It is apparent from FIGS. 2 and 2A the rods 34 extend into the hoppers a suitable distance such as, for example, 10 to 40 inches along the slope sheets 20. A vibrator mounting bracket 36 is then welded to rods 34 and plate 32 bracket 36 has first and second bracket planar surfaces **36*a* and 36*b* which are parallel to the longitudinal axis $a_1$ of rod 34. Again, as shown in FIG. 2A, rods 34** and vibrator bracket 36 extend outwardly from the side of the car a suitable distance sufficient for the vibrator to grasp the mounting plate 32, but insufficient to violate AAR transverse clearance restrictions. For example, an outward extension of about 2 to 12 inches may be used. A suitable vibrator is indicated in the drawings generally at V. The vibrator may be any of the known and/or commercially available vibrators for vibrating railway cars and/or industrial bins, example of which vibrators are illustrated in the foregoing patents, which may be clamped to mounting plate 32, or modified to do so may be used the vibrators are clamped to the surfaces 36*a* and 36*b* of mounting plate 36.

Vibrators generally are of two types. The reciprocating type applies the vibrator loads to the bracket in a back and forth linear motion usually by means of a piston. This results in a transverse Force vector shown generally as $T_1$, into the rods 34 in FIG. 2A which is taken out by shear loads $S_1$, applied to slope sheets 20.

The rotating type vibrator results in a rotating vector shown generally as $RV_2$ for any given time which may be resolved into a transverse component $T_2$ and a longitudinal component $L_2$. The transverse component is taken out by shear loads $S_2$ applied to slope sheets 20. The longitudinal component $L_2$ is taken out by shear loads $SS_2$ applied to the side sheets (18*a* in FIG. 2A), and by a couple $C_2$ which applies shear loads to slope sheets 20.

In another embodiment of the present invention shown in FIG. 3, a vibrator bracket assembly indicated generally at 130 is applied to the roof portion of the car. Railway car 10 is provided with a suitable roof sheet 50 and a plurality of hatches 52, 54 and 56 respectively for loading hoppers 14, 16 and 18. In accordance with this embodiment the vibrator bracket assembly is mounted between hatches 52 and 54 or between hatches 54 and 56. By way of example, it will be assumed that the vibrator assembly is mounted between hatches 52 and 54 adjacent transverse bulkhead 15.

Vibratory bracket assembly 130 comprises a horizontally extending plate 132 which is preferably provided with generally vertically extending support members 134 and 135 which extend transversely of the car. These support members may comprise a suitable angle, channel or T-shaped member which is preferably welded to opposite ends of plate 132 as indicated. Assembly 130 further comprises a mounting bracket 136 which extends generally transversely of the car and vertically above the car. Bracket 136 is welded to plate 132 bracket 136 is provided with first and second bracket planar surfaces 136*a* and 136*b* suitable for mounting a bracket thereon as illustrated in FIG. 3. At opposite ends of bracket 136 vertically extending plates 140 and 142 are integrally affixed thereto, preferably by welding plates 141 and 142 each have an longitudinal axis $a_2$ extending vertically in FIG. 3. Suitable openings 51 and 53 are cut in roof sheet 50, and plates 140 and 142 are provided with slots respectively 141 and 143 adapted to engage transverse bulkhead 15 by welding as shown. A suitable vibrator V is then mounted on surfaces 136*a* and 136*b* of bracket 136.

The vibrating loads are applied in a manner similar to that described in FIG. 2A. The piston-reciprocating type vibrator applies a vertical force vector shown generally as $V_3$ which is in turn applied by plates 140 and 142 to bulkhead 15 as shear loads $BS_3$. The rotating vibrator results in a rotating force vector shown generally as $RV_4$ for any given time which may be resolved into a transverse component $T_4$ and a vertical component $V_4$. The vertical component $V_4$ is applied to the bulkhead as shear forces $BS_4$. The transverse component $T_4$ is applied to the roof sheet as shear forces $RS_4$, by means of plate 132, and corresponding couple forces $C_4$ are applied to bulkhead 15 as shear by plates 140 and 142.

Figure 4:
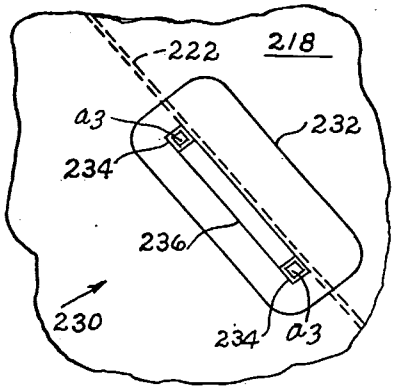
FIG. 4 is a side view along the lines 4—4 of FIG. 1 in which the bracket assembly is applied to a single slope sheet and side sheet.

In another embodiment of the invention the vibrator bracket assembly may be applied to a single slope sheet as shown in FIG. 4. In this embodiment a vibrator mounting bracket 236 is applied to a slope sheet 222 and to a side sheet 218. Rods 234 are integrally affixed preferably by welding to slope sheet 222 rods 234 each have a longitudinal axis $a_3$. Preferably a plate 232 is also applied to sheet 218.

The loads resulting from a reciprocating type vibrator are applied as shear forces to slope sheet 222 and the loads resulting from a rotating type vibrator applied as shear forces to side sheet 218 and the corresponding couple forces are applied as shear to the slope sheet, according to the same principles as described in regard to the embodiments shown in FIGS. 2 and 3.

The vibrator bracket assembly can also be applied directly to the side sheets of a flat sided hopper car. Thus, as shown in FIG. 5 a vibrator bracket assembly 430 having a mounting bracket 432 may be applied at eighter end of the car and supports 434 will apply shear and couple forces respectively to side sheets 414 and 418 supports 434 each have a longitudinal axis $a_4$. As described above, a rotating vibrator results in a vertical component which may be applied as shear to end sheet 440 or side sheet 418, individually or in combination as desired.

In still another embodiment shown in FIG. 5, a bracket assembly 530 having a mounting bracket 532 may be applied to the side sheet 516 and to roof sheet 550 bracket in assembly 530 includes a pair of supports 534 each having a longitudinal axis $a_5$. When a reciprocating vibrator is used, the bracket assembly 530 causes the application of shear force to side sheet 516 and when a rotary vibrator is used, bracket assembly 530 causes the application of shear force to the roof sheet 550 or the side sheet 516 (individually or in combination as desired) and the corresponding couple forces are applied to side sheet 516 as shear.

Figure 5A:
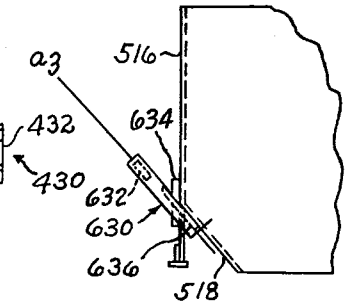
FIG. 5A is a view along the lines 5A—5A in FIG. 5.
Figure 5:
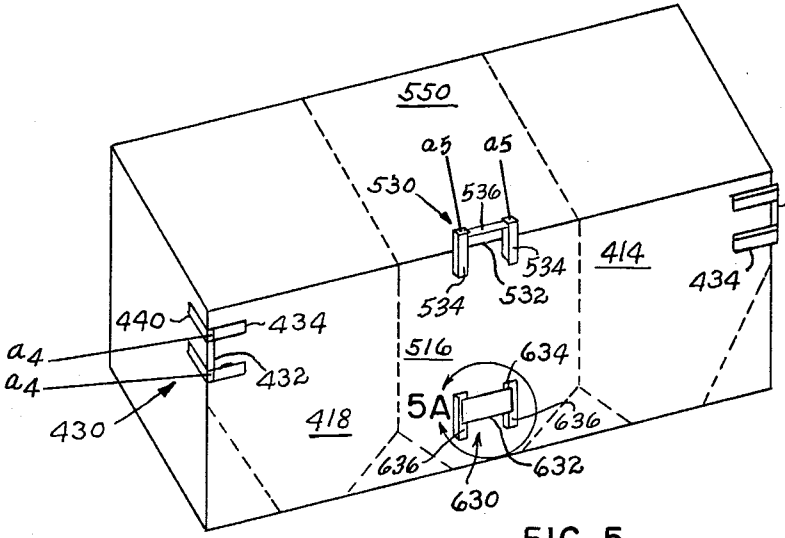
FIG. 5 is a perspective view of other embodiments of the present invention in which the vibrator bracket assembly is applied to a flat sided hopper car.

In still another embodiment shown in FIGS. 5 and 5A a bracket assembly 630 may be applied to side sheet 516 and slope sheet 518. A pair of supports 636 are integrally affixed to inwardly inclined slope sheet 518 and a pair of plates 634 extend vertically. Supports 636 are provided with a longitudinal axis $a_6$. Mounting plate 632 is parallel thereto. Shear from reciprocating vibrators is applied to inclined slope sheet 518 by means of supports 636. The rotary type vibrator applies shear to side sheet 516 and slope sheet 518, and a couple to slope sheet 518.

Since in all of the embodiments the vibratory loads are applied to the car structure in shear, the problem of bending stresses resulting in fatigue failures, particularly adjacent to the vibrator, according to prior art mounting bracket assembly, is largely reduced or eliminated.

It will be apparent that the vibratory bracket assembly of the present invention may be applied to all kinds of hopper cars including covered hopper cars, pressure cars, pressure differential cars, and to open top hopper cars, such as coal and ore cars.

It is also within the purview of the present invention to utilize the vibratory bracket assembly of the present invention to densify the lading as the car is being loaded, or after the car is partially loaded to facilitate obtaining as full a load as possible during transit. Examples of ladings for which densification is desirous are plastic pellets, asbestos, diatomaceous earth, kaolin clay and talc.

The following is a specific example of using the vibratory bracket of the present invention.

Two ACF cars at West Memphis, Ark. were selected and one vibrator bracket assembly was applied to each car per the application described in FIGS. 1, 2 and 2A.

A demonstration test to determine unloading characteristics of system was performed at Temple Gypsum facilities in West Memphis, Ark.

1. Cars were Amcar 3560 ft.$^3$ Center Flow ® hopper cars.

2. Commodity - Gypsum Rock (varies from first size rocks to powder fines).

3. Vibrator used at bracket assembly was designated CCV6-50-6A "Brute" manufactured by Martin Engineering Co., Neponset, Illinois.

4. Vibrator was operated at a pneumatic line pressure of 60 psig (which is equivalent to a vibration frequency of 2,200 rpm and a force output of 7,000 lbs.).

5. Elapsed time for complete unloading; approximately 20 minutes.

6. Examination following test showed no car damage.

A structural endurance test was performed at Temple Gypsum facilities over a four-day period. Purpose of test was to subject vibrator bracket and empty car to eight hour continuous vibration in order to determine extent of structural damage. Significant items:

1. Line pressure was 60 psig and same vibrator as mentioned previously; measurements indicated as follows: frequency, 2,600 rpm and peak force output, 9,500 lbs.

2. Local structure and general car structure were examined periodically to determine damage.

3. After 8 hours duration no damage occurred to the vibrator bracket or to car structure to which it was attached. There was damage of a minor nature which occurred at running board support brackets and brake line support brackets (which was readily and quickly repaired at minor expense).

4. The test was a complete success from the standpoint of no structural damage to the car structure to which the shear loads were applied.

Since the vibratory bracket assembly of the present invention applies to the vibratory loads to the structural parts of the car in shear, there is much less likelihood that use of vibrators to effect densification will result in fatigue failures of car parts, particularly those adjacent the area where the shear loads are applied.

What is claimed is:

1. A railway hopper car comprising: a plurality of hoppers supported by trucks at opposite ends of the car; said hoppers comprising at least one hopper slope sheet at the lower portion thereof; at least two spaced support members adapted to extend parallel to and integrally engage, respectively, a hopper planar surface of at least one of said hoppers; said spaced support members each having a longitudinal axis; a vibrator mounting bracket extending between said support members and having first and second planar surfaces, said planar surfaces being parallel to the longitudinal axis of said spaced support members and adapted to receive a vibrator suitable for facilitating loading and/or unloading of the hopper by applying vibrational forces to the hopper; whereby reciprocating vibrational forces applied to the vibrator mounting bracket are transmitted through said spaced support members and are applied to said hopper planar surface essentially entirely as shear loads in the plane of said hopper planar surface.

2. A railway hopper car according to claim 1 wherein a mounting plate is provided at an angle to said vibrator mounting bracket and parallel to adjacent hopper structure having a second hopper planar surface, and wherein said mounting plate is adapted to apply a rotating vibrator shear load to said second hopper planar surface, and wherein additional rotational vibrational loads are applied through said spaced support members to said hopper planar surface essentially entirely in shear.

3. A railway hopper car comprising: a plurality of hoppers supported by trucks at opposite ends of the car; at least two of said hoppers having a transverse slope sheet planar surface and an adjacent side sheet planar surface; at least no spaced support members adapted to extend parallel to and integrally engage respectively one of said transverse slope sets; said spaced support members each having a longitudinal axis; a vibrator mounting bracket extending between said support members and having first and second bracket planar surfaces, said bracket planar surfaces being parallel to the longitudinal axis of said spaced support members and adapted to receive a vibrator suitable for facilitating loading and/or unloading of the hopperby applying vibrational forces to the hopper; whereby reciprocating vibrational forces applied to the vibrator mounting bracket are transmitted through said spaced support members and respectively are applied to said transverse hopper slope sheets planar surfaces essentially entirely as shear loads in the plane of said transverse slope sheet planar surfaces.

4. A railway hopper car according to claim 3 wherein said spaced support members engage adjacent slope sheets.

5. A railway hopper car according to claim 3 wherein said support member engages the same slope sheet.

6. A railway hopper car according to claim 3 wherein a mounting plate is provided at an angle to said vibrator mounting bracket and parallel to one of said adjacent hopper side sheets having a side sheet planar surface; and wherein said mounting plate is adapted to apply a rotating vibrator shear load to said side sheet planar surface, and wherein additional rotational vibrational loads are applied through said spaced members to said transverse slope sheet planar surfaces essentially entirely in shear.

7. A railway hopper car comprising: a plurality of hoppers supported by trucks at opposite ends of the car; said hoppers comprising a transverse bulkhead between said hoppers having a bulkhead planar surface; at least two spaced support members adapted to extend parallel to and integrally engage a planar surface of said bulkhead; said support members each having a longitudinal axis; a vibrator mounting bracket extending between said support members and having first and second bracket planar surfaces, said bracket planar surfaces being parallel to the longitudinal axis of said spaced support members and adapted to receive a vibrator suitable for facilitating loading and unloading of the hopper by applying vibrational forces to the hopper; whereby reciprocating vibrational forces applied to the vibrator mounting bracket are transmitted through said spaced support members and are applied to said bulkhead essentially entirely as shear loads in the plane of said bulkhead planar surface.

8. A railway hopper car according to claim 7 wherein a mounting plate is provided at an angle to said vibrator mounting bracket and parallel to adjacent hopper structure having a second planar surface and wherein said mounting plate is adapted to apply a rotating vibrator shear load to said second planar surface, and wherein additional rotational vibrational loads are applied through said spaced members to said bulkhead planar surface essentially entirely in shear.

9. A railway hopper car according to claim 8 wherein said adjacent hopper structure is at least a portion of a hopper car roof.

10. A railway hopper car comprising: a plurality of hoppers supported by trucks at opposite ends of the car; said hoppers comprising at least two spaced support members adapted to extend parallel to and integrallly engage a planar side sheet surface of at least one of said hoppers; said spaced support members each having a longitudinal axis; a vibrator mounting bracket extending between said support members and having first and second bracket planar surfaces, said bracket planar surfaces being parallel to the longitudinal axis of said spaced support members and adapted to receive a vibrator suitable for facilitating loading and/or unloading of the hopper by applying vibrational forces to the hopper; whereby reciprocating vibrational forces applied to the vibrator mounting bracket and transmitted through said spaced support members and are applied to said side sheet essentially entirely as shear loads in the plane of said side sheet planar surface.

11. A railway car according to claim 10 wherein a mounting plate is provided at an angle to said vibrator mounting bracket and parallel to adjacent hopper structure having a second hopper planar surface, and wherein said mounting plate is adapted to apply a rotating vibrator shear load to said second planar surface, and wherein additional rotational vibrational loads are applied through said spaced members to said second hopper planar surface essentially entirely in shear.

12. A railway hopper car according to claim 10 wherein said support members extend longitudinally of the car along said side sheets.

13. A railway hopper car according to claim 1 wherein said support members extend vertically on said side sheet.

* * * * *

UNITED STATES PATENT AND TRADEMARK OFFICE

CERTIFICATE OF CORRECTION

PATENT NO. : 4,068,768

DATED : January 17, 1978

INVENTOR(S) : Paul E. Hicks, Jr.

It is certified that error appears in the above-identified patent and that said Letters Patent are hereby corrected as shown below:

Column 1, line 5, "Aug. 8," should read -- Aug. 2, --.
line 11, "loadings" should read -- ladings --.
line 32, "lescription" should read -- description --.
Column 2, line 68, "32 bracket 36" should read -- 32. Bracket 36 --.
Column 3, line 49, insert a period after "132".
line 50, "bracket 136" should read -- Bracket 136 --.
line 54, insert a period after "welding".
line 55, "plates 141 and 142" should read -- Plates 141 and 142 --.
Column 4, line 13, "sheet 222 rods 234" should read -- sheet 222. Rods 234 --.
line 27, "eighter" should read -- either --.
line 29, "418 supports 434" should read -- 418. Supports 434 --.
line 37, "550 bracket in" should read -- 550. Bracket in --.
Column 6, line 19, "no" should read -- two --, and line 21, "sets" should read -- sheets --, and line 28, "hopperby" should read -- hopper by -- and in line 64, "and" should read -- and/or --.

Signed and Sealed this

Thirtieth Day of May 1978

[SEAL]

Attest:

RUTH C. MASON
Attesting Officer

LUTRELLE F. PARKER
Acting Commissioner of Patents and Trademarks